US011030878B2

(12) United States Patent
Dillon et al.

(10) Patent No.: US 11,030,878 B2
(45) Date of Patent: Jun. 8, 2021

(54) TOOL SAFETY SYSTEM

(71) Applicant: Smart Harness Systems, LLC, Cypress, TX (US)

(72) Inventors: James David Dillon, Liberty, TX (US); Adam Laubach, College Station, TX (US)

( * ) Notice: Subject to any disclaimer, the term of this patent is extended or adjusted under 35 U.S.C. 154(b) by 0 days.

(21) Appl. No.: 16/786,945

(22) Filed: Feb. 10, 2020

(65) Prior Publication Data

US 2020/0394891 A1 Dec. 17, 2020

Related U.S. Application Data

(60) Provisional application No. 62/803,458, filed on Feb. 9, 2019.

(51) Int. Cl.

| | |
|---|---|
| ***G08B 21/18*** | (2006.01) |
| ***G08B 21/02*** | (2006.01) |
| ***G08B 3/10*** | (2006.01) |
| ***A45F 5/00*** | (2006.01) |
| ***G08B 25/00*** | (2006.01) |
| *B25H 3/00* | (2006.01) |

(52) U.S. Cl.

CPC ..... *G08B 21/185* (2013.01); *A45F 5/00* (2013.01); *G08B 3/10* (2013.01); *G08B 21/02* (2013.01); *G08B 25/00* (2013.01); *A45F 2005/006* (2013.01); *A45F 2200/0575* (2013.01); *B25H 3/00* (2013.01)

(58) Field of Classification Search

CPC ..... G08B 21/185

See application file for complete search history.

(56) References Cited

U.S. PATENT DOCUMENTS

2009/0078505 A1* 3/2009 Casebolt ..... A62B 35/0093 182/231

2017/0065065 A1* 3/2017 Brewner ..... A45F 5/021

* cited by examiner

*Primary Examiner* — Travis R Hunnings

(74) *Attorney, Agent, or Firm* — Shannon Warren

(57) ABSTRACT

A tether tracking system configured to secure and monitor a one or more tools to prevent drops and accidents by a worker. The tether tracking system comprises a base portion, a two or more straps, a one or more hooks, a tool strap and a one or more hook anchors. The two or more straps comprise at least a first strap and a second strap. The first strap comprises a first end and a second end. The second strap comprises a first end and a second end. The two or more straps are attached to the base portion with the second end of the first strap and the second end of the second strap attached to the base portion. The first end of the second strap is attached to the tool strap. The tool strap is configured to selectively attach to one among a one or more tool tethers.

1 Claim, 9 Drawing Sheets

PRIOR ART

TOOL SAFETY SYSTEM

CROSS-REFERENCE TO RELATED APPLICATIONS

This application claims benefit to U.S. Patent Application No. 62/803,458 filed on Feb. 9, 2019.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant

BRIEF SUMMARY OF THE INVENTION

A tether tracking system configured to secure and monitor a one or more tools to prevent drops and accidents by a worker. Said tether tracking system comprises a base portion, a two or more straps, a one or more hooks, a tool strap and a one or more hook anchors. Said two or more straps comprise at least a first strap and a second strap. Said first strap comprises a first end and a second end. Said second strap comprises a first end and a second end. Said two or more straps are attached to said base portion with said second end of said first strap and said second end of said second strap attached to said base portion. Said first end of said second strap is attached to said tool strap. Said tool strap is configured to selectively attach to one among a one or more tool tethers. Said one or more hook anchors comprise at least a first hook anchor. Said one or more hooks comprise at least a first hook. Said first end of said first strap is attached to said first hook. each among said one or more hooks are configured to selectively attach to said one or more hook anchors. Said tether tracking system is configured to monitor safety conditions of said one or more tools by: attaching a controller between a two or more ground signals on a two or more lines. monitoring said two or more ground signals to ensure that at least one of said two or more lines are grounded. sending an alarm signal with said controller when a monitoring step determines none of said two or more lines are grounded to said two or more ground signals. Said two or more ground signals are associated with at least said one or more hook anchors. Said two or more lines are integrated into said two or more straps.

DETAILED DESCRIPTION OF THE INVENTION

Figure 1:
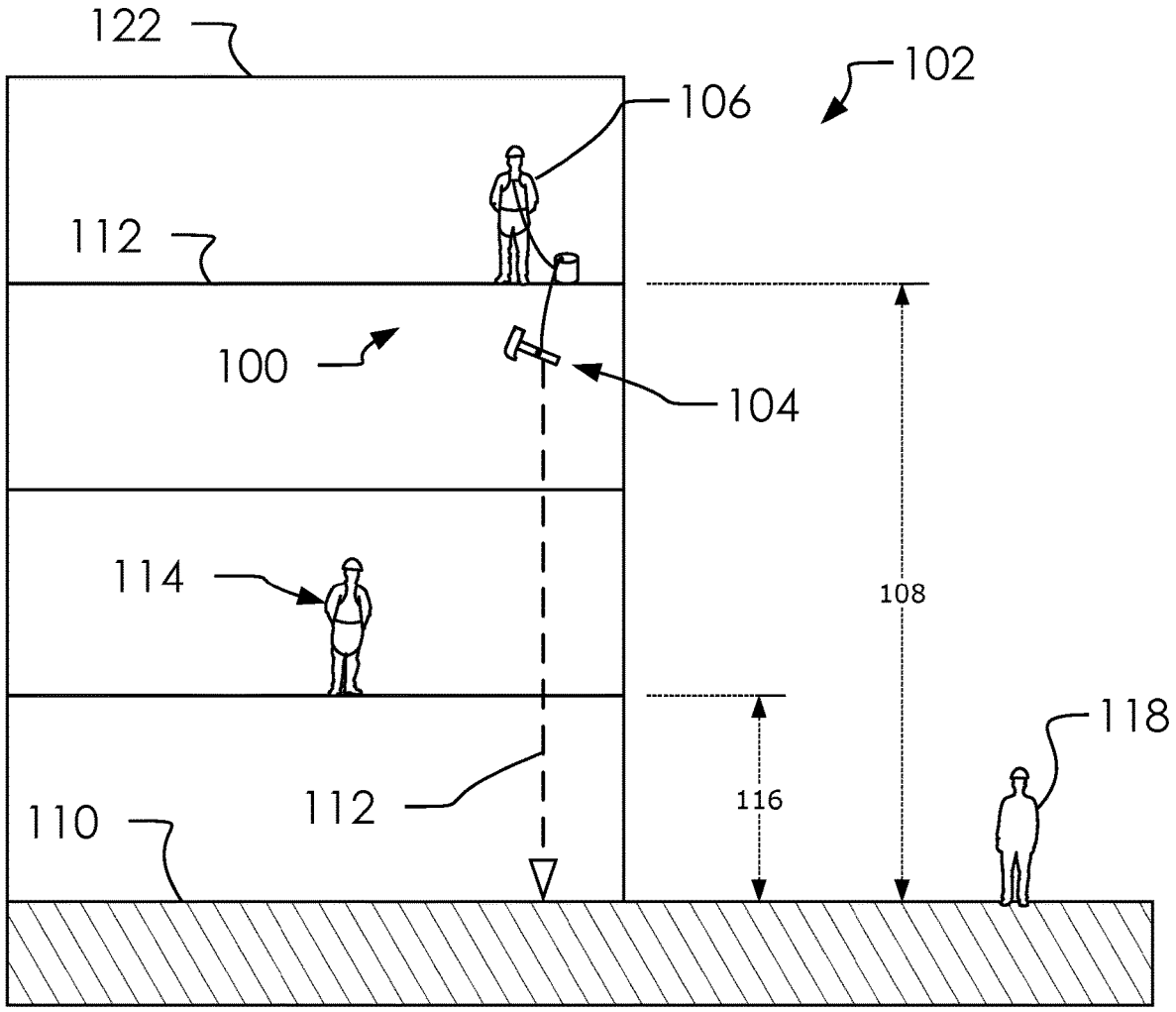
FIG. 1 illustrates a perspective overview a worksite 102 with a worker 106 dropping a tool 104 attached to a tether tracking system 100.

FIG. 1 illustrates a perspective overview a worksite 102 with a worker 106 dropping a tool 104 attached to a tether tracking system 100.

In one embodiment, said tether tracking system 100 can selectively secure one or a plurality of said tool 104 to said worker 106.

For many construction workers, working at a first elevation 108 above a ground 110 can comprise a risky undertaking. For example, where construction is conducted at a first work location 112 at said first elevation 108, a lower elevation worker 114 at a second elevation 116 being below said first work location 112 might be hit by said tool 104 when falling toward said ground 110 along a falling path 120.

In one embodiment, a supervisor 118 can monitor conditions at said worksite 102 including the status of said tether tracking system 100, as discussed herein.

In one embodiment, said worksite 102 can comprise a scaffolding structure 122, as is known in the art.

Figure 2:
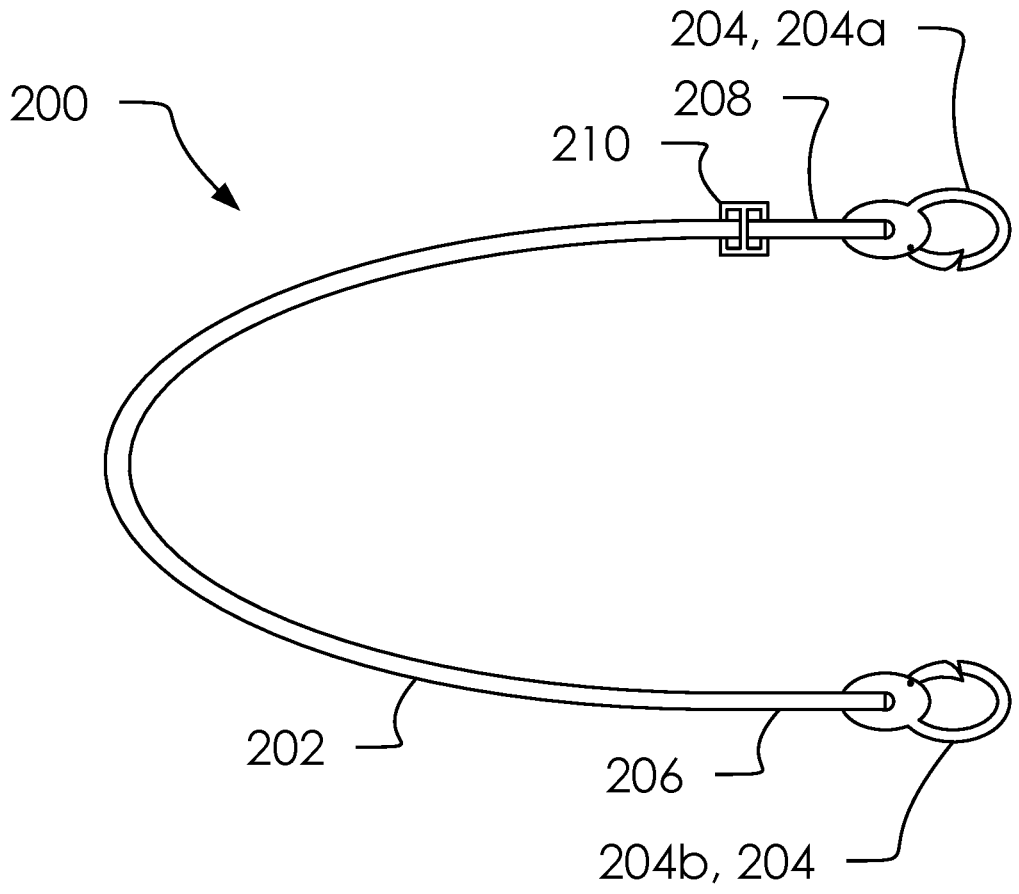
FIG. 2 illustrates a perspective overview of a prior art tether 200.

FIG. 2 illustrates a perspective overview of a prior art tether 200.

The prior art has developed means for securing said tool 104 to said worker 106 using said prior art tether 200. In one embodiment, said prior art tether 200 can comprise a strap portion 202, a two hook assemblies 204 (comprising a first hook assembly 204*a* and a second hook assembly 204*b*) attached at a first end 206 and a second end 208 of said strap portion 202, and an adjustment buckle 210, as illustrated.

Said prior art tether 200 is designed to attach to attach said tool 104 to said worker 106 in order to prevent injuries to said lower elevation worker 114. However, in the real world, said worker 106 tend to take shortcuts and fail to keep said tool 104 tethered at all times. Indeed, injuries occur and near misses happen all the time in industrial construction settings. Human distraction and laziness tend to cause more injuries than equipment failure. On objective of said tether tracking system 100 is to compensate for these human errors.

Figure 3:
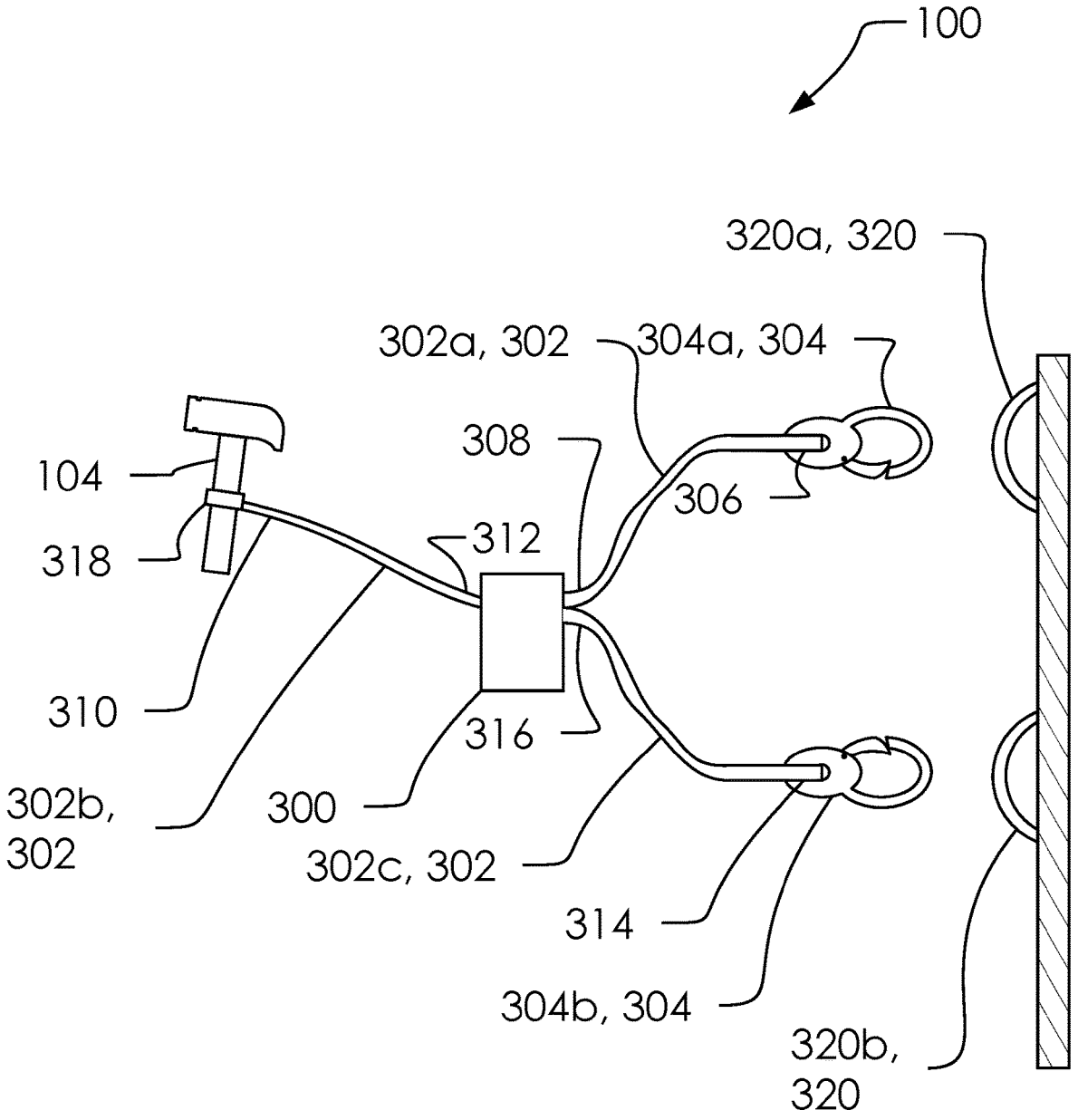
FIG. 3 illustrates a perspective overview of said tether tracking system 100.

FIG. 3 illustrates a perspective overview of said tether tracking system 100.

In one embodiment, said tether tracking system 100 can comprise a base portion 300, a two or more straps 302, a one or more hooks 304, a first end 306, a second end 308, a first end 310, a second end 312, a first end 314, a second end 316, a tool strap 318 and a one or more hook anchors 320. In one embodiment, said two or more straps 302 can comprise a first strap 302*a*, a second strap 302*b* and a third strap 302*c*. Said one or more hooks 304 can comprise a first hook 304*a* and a second hook 304*b*. Said one or more hook anchors 320 can comprise a first hook anchor 320*a* and a second hook anchor 320*b*.

Each of said two or more straps 302 are configured to attach to said base portion 300 with said second end 308, said second end 312 and said second end 316, respectively.

Further, said first end 306 of said first strap 302*a* can attach to said first hook 304*a*; said first end 310 of said second strap 302*b* can attach to said second hook 304*b*; and said first end 314 of said third strap 302*c* can attach to said tool strap 318.

Accordingly, said tool strap 318, said first hook anchor 320*a* and said second hook anchor 320*b* can be attached to one another with said base portion 300 and said two or more straps 302, as illustrated.

In one embodiment, said two or more straps 302 can comprise a strong fabric strap, as is known in the art. However, unlike said prior art tether 200, in one embodiment, said two or more straps 302 can have an added feature of electronic circuits, as discussed below.

Figure 4:
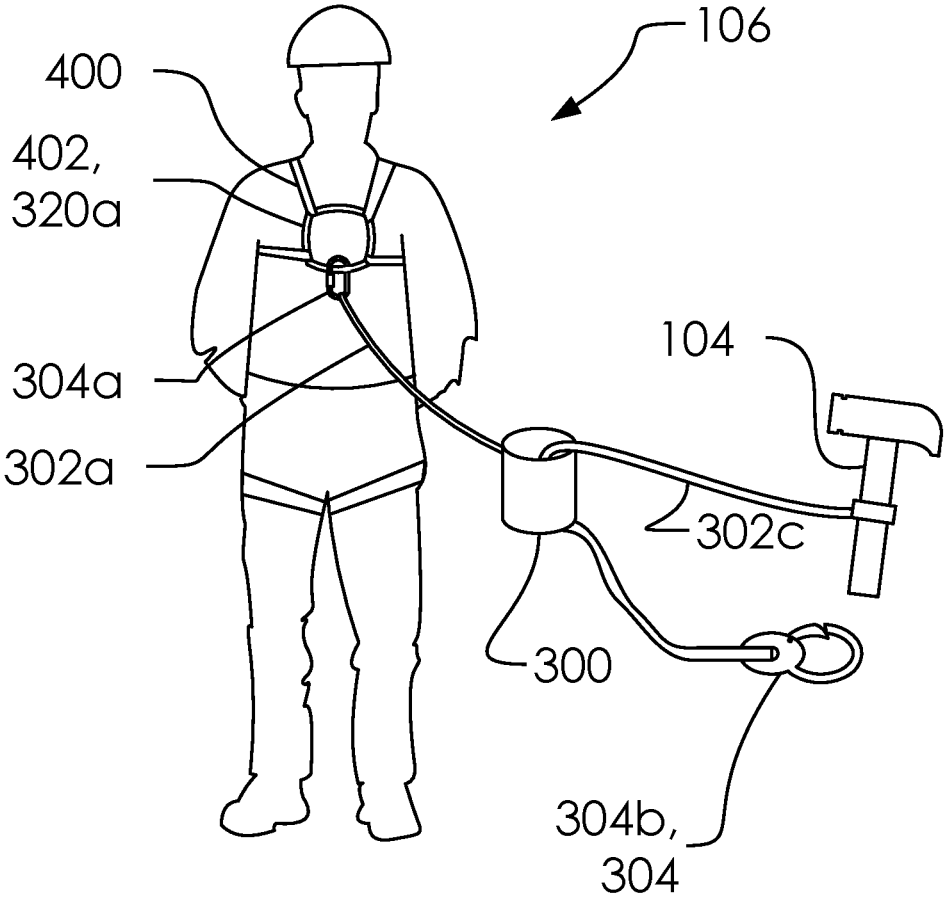
FIG. 4 illustrates a perspective overview of said worker 106 with said tether tracking system 100 attached to a harness system 400.

FIG. 4 illustrates a perspective overview of said worker 106 with said tether tracking system 100 attached to a harness system 400.

In one embodiment, said harness system 400 can comprise a safety harness, as is known in the art. In one embodiment, said harness system 400 can comprise an inductive anchor 402 to function as said one or more hook anchors 320. In one embodiment, all metallic portions of said harness system 400 can comprise said inductive anchor 402. In one embodiment, said inductive anchor 402 can comprise an enclosed loop where portions of said harness system 400 tie together. In one embodiment, said inductive anchor 402 is adapted to receive a portion of one among said two hook assemblies 204, such as said first hook assembly 204*a*, as illustrated.

Figure 5:
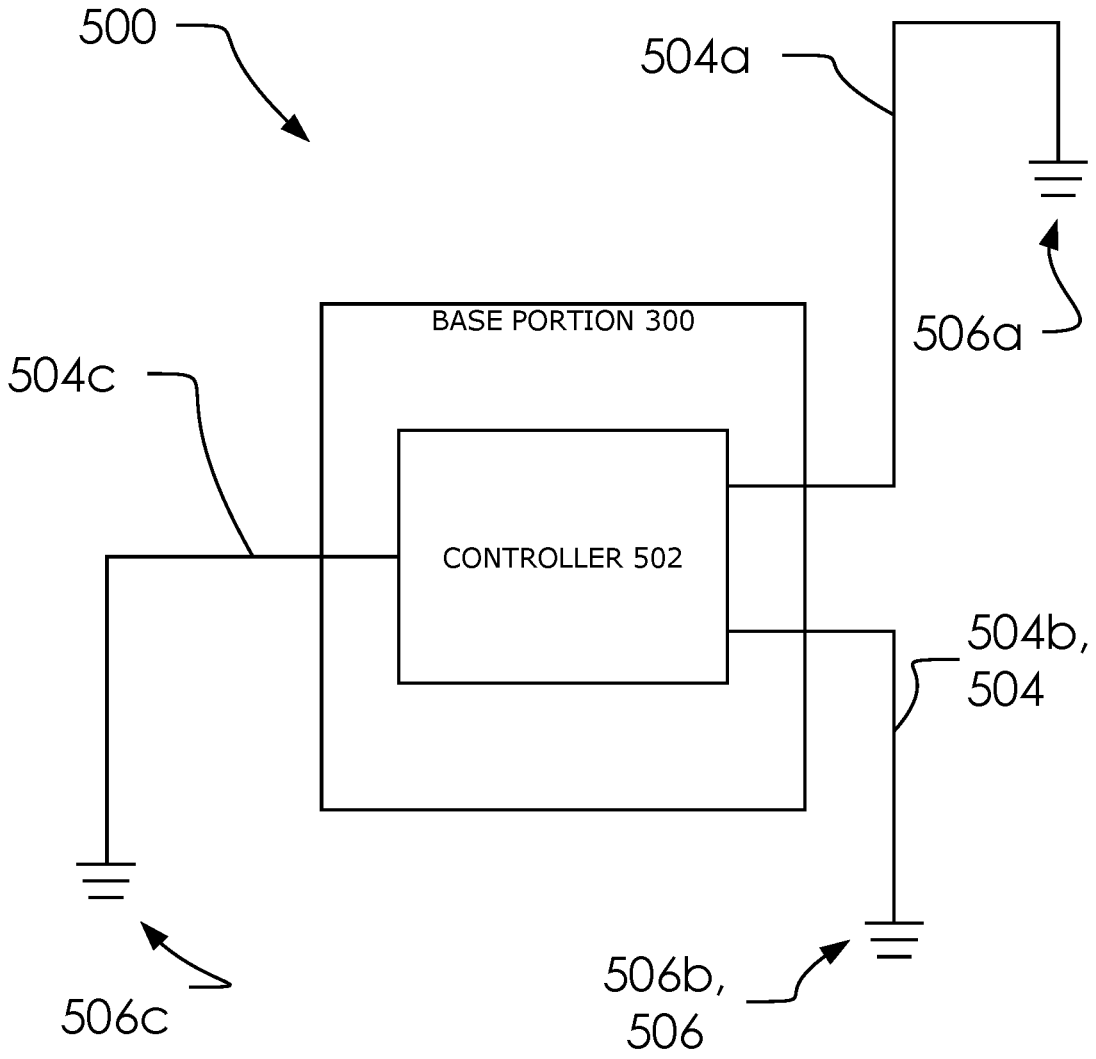
FIG. 5 illustrates a sensor circuit 500 of said tether tracking system 100.

FIG. 5 illustrates a sensor circuit 500 of said tether tracking system 100.

In one embodiment, said sensor circuit 500 can comprise a controller 502, a two or more lines 504 and a two or more ground signals 506. Said two or more lines 504 can comprise a first line 504*a*, a second line 504*b* and a third line 504*c*. Said two or more ground signals 506 can comprise a first ground signal 506*a*, a second ground signal 506*b* and a third ground signal 506*c*.

In one embodiment, said base portion 300 can be used to monitor conditions of said one or more hooks 304 and said tool strap 318. In one embodiment, said two or more straps 302 can comprise said two or more lines 504 within the strap material; wherein, said first strap 302*a* and said first line 504*a*, said second strap 302*b* and said second line 504*b*, and said third strap 302*c* and said third line 504*c* can be associated with one another. In one embodiment, said two or more ground signals 506 can be created by attaching said one or more hook anchors 320 and/or said tool strap 318 to said one or more hook anchors 320 or said tool 104.

In one embodiment, said controller 502 can monitor said two or more lines 504 for a ground (such as said two or more ground signals 506) to determine if said one or more hook anchors 320 are attached to said one or more hooks 304 or, possibly, said tool strap 318. However, said tool strap 318 may or may not be configured for this circuit analysis, pursuant to the requirements of said worker 106 or other end users associated with said tether tracking system 100.

In one embodiment, said controller 502 can be integrated into said base portion 300, as illustrated. In another embodiment, said controller 502 can be located anywhere between said two or more ground signals 506 on said sensor circuit 500.

In one embodiment, said two or more ground signals 506 can comprise said first ground signal 506*a* and said second ground signal 506*b* as between said two hook assemblies 204.

Accordingly, said tether tracking system 100 can be configured to determine whether a portion of said one or more hooks 304 are attached to a portion of said one or more hook anchors 320.

Figure 6:
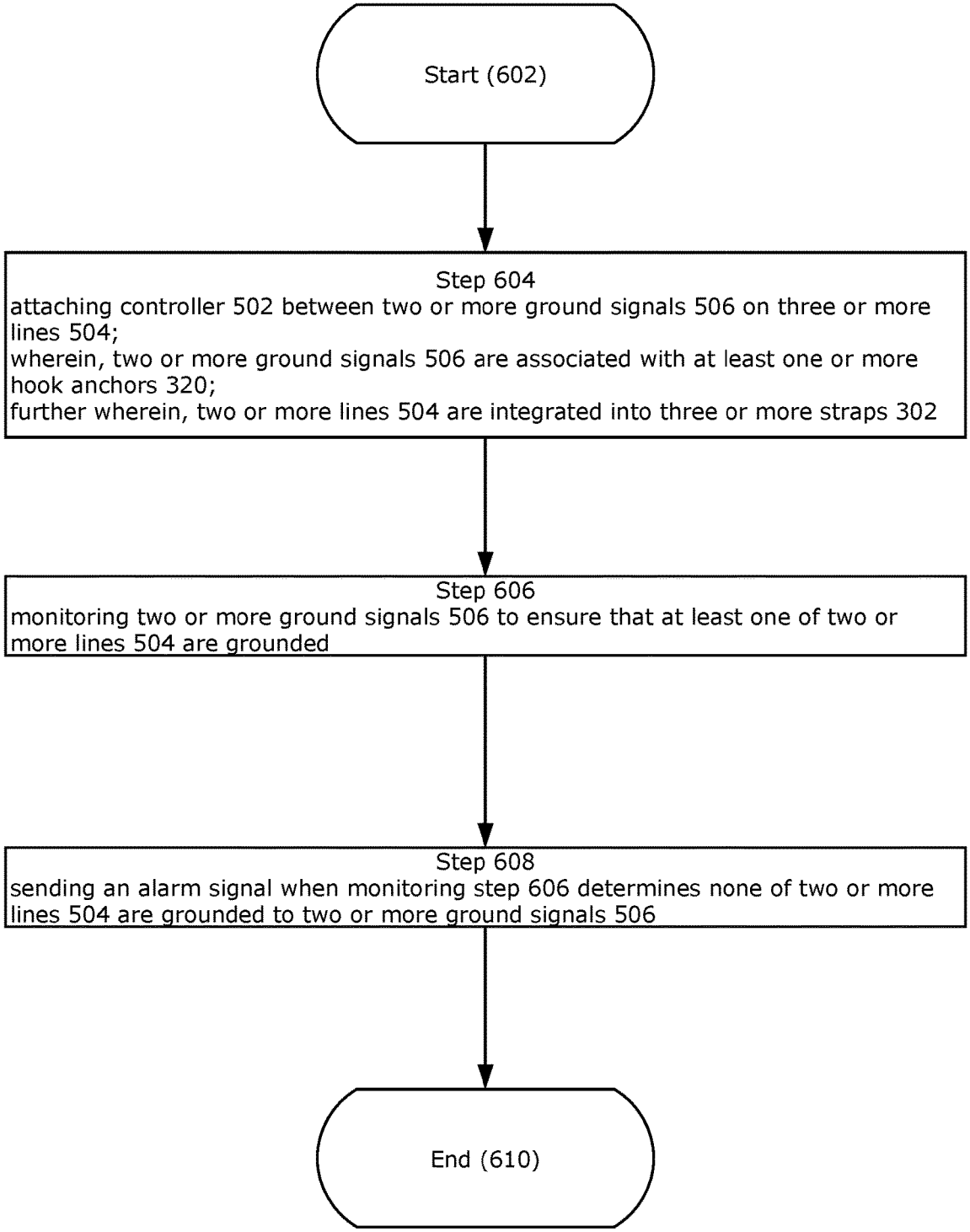
FIG. 6 illustrates a method of use 600 for said tether tracking system 100.

FIG. 6 illustrates a method of use 600 for said tether tracking system 100.

Said method of use 600 can comprise a starting step 602, a configuration step 604, a monitoring step 606, an alarming step 608, and an end step 610.

In one embodiment, said configuration step 604 can comprise attaching said controller 502 between said two or more ground signals 506 on said two or more lines 504; wherein, said two or more ground signals 506 are associated with at least said one or more hook anchors 320; further wherein, said two or more lines 504 are integrated into said two or more straps 302.

Said two or more ground signals 506 can be grounded when said one or more hook anchors 320 are in contact with a metallic structure such as said scaffolding structure 122, said one or more hook anchors 320, or similar.

Said monitoring step 606 can comprise monitoring said two or more ground signals 506 to ensure that at least one of said two or more lines 504 are grounded.

Said alarming step 608 can comprise said controller 502 sending an alarm signal when said monitoring step 606 determines none of said two or more lines 504 are grounded to said two or more ground signals 506.

In one embodiment, said alarming step 608 can comprise an audible alarm, a digital alarm carried over a network to a server, a signal to a supervisor or colleague, or other as may be expected in the art.

Figure 7:
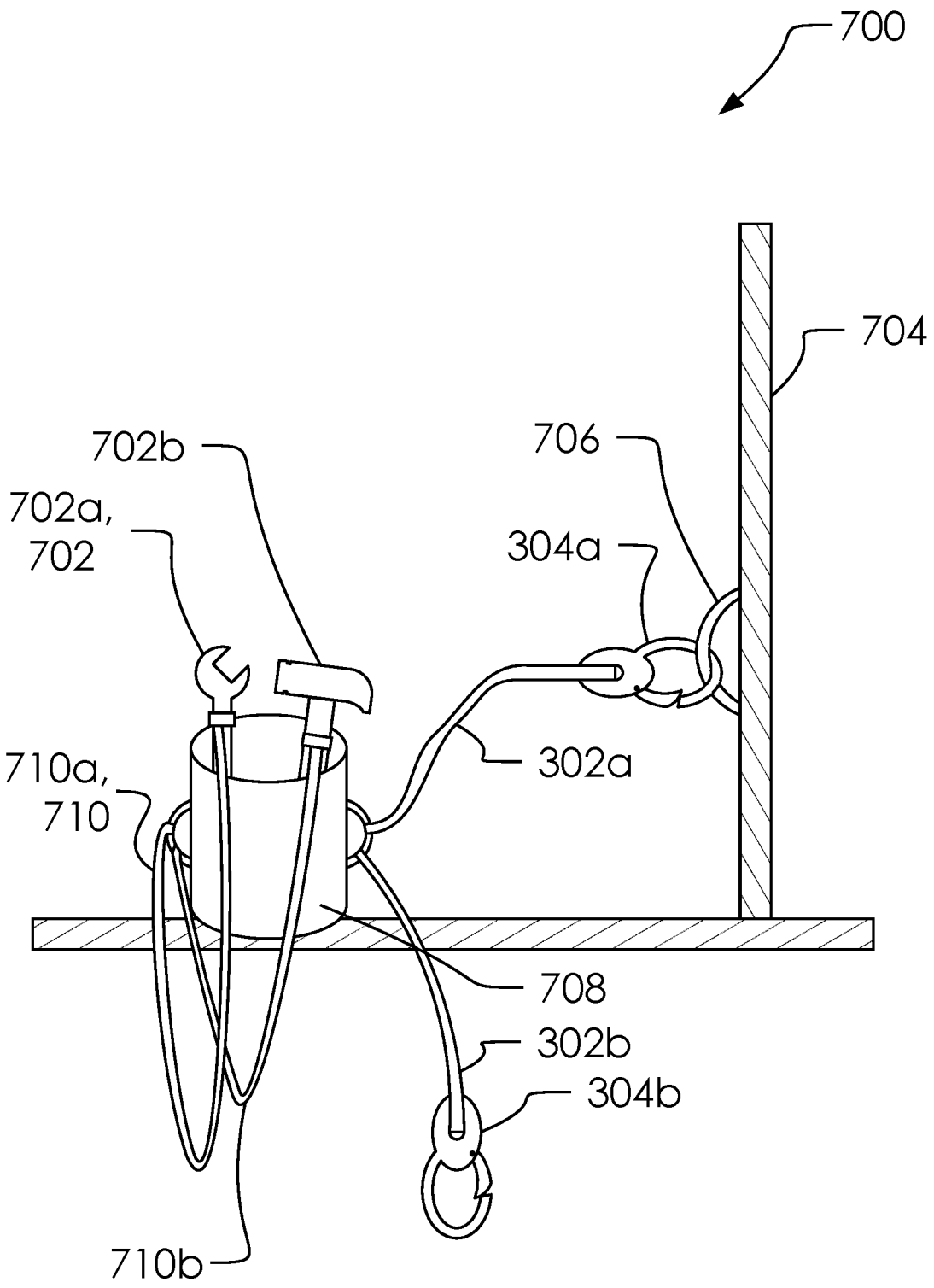
FIG. 7 illustrates a perspective overview of a tool tether configuration 700 of said tether tracking system 100.

FIG. 7 illustrates a perspective overview of a tool tether configuration 700 of said tether tracking system 100.

Said tool tether configuration 700 can comprise a bag 708 and a one or more tool tethers 710. Said bag 708 can be configured to safely hold a one or more tools 702 each attached to said one or more tool tethers 710. In one embodiment, said tool tether configuration 700 of said tether tracking system 100 can be configured to attach said bag 708 to a mounted hook 706 of a mounting structure 704; and said one or more tools 702 attached to said bag 708 with said one or more tool tethers 710, as illustrated.

In one embodiment, said one or more tools 702 can comprise first tool 702*a* and second tool 702*b*.

Further, said bag 708 can house said controller 502 and thereby function as said base portion 300. In one embodiment, said two or more straps 302 and said one or more tool tethers 710 can attach to said bag 708. In one embodiment, said tool tether configuration 700 can confirm at least one among said one or more hooks 304 are attached to either said worker 106 or said mounted hook 706 of said mounting structure 704. In one embodiment, said mounted hook 706 of said mounting structure 704 can be grounded.

Figure 8:
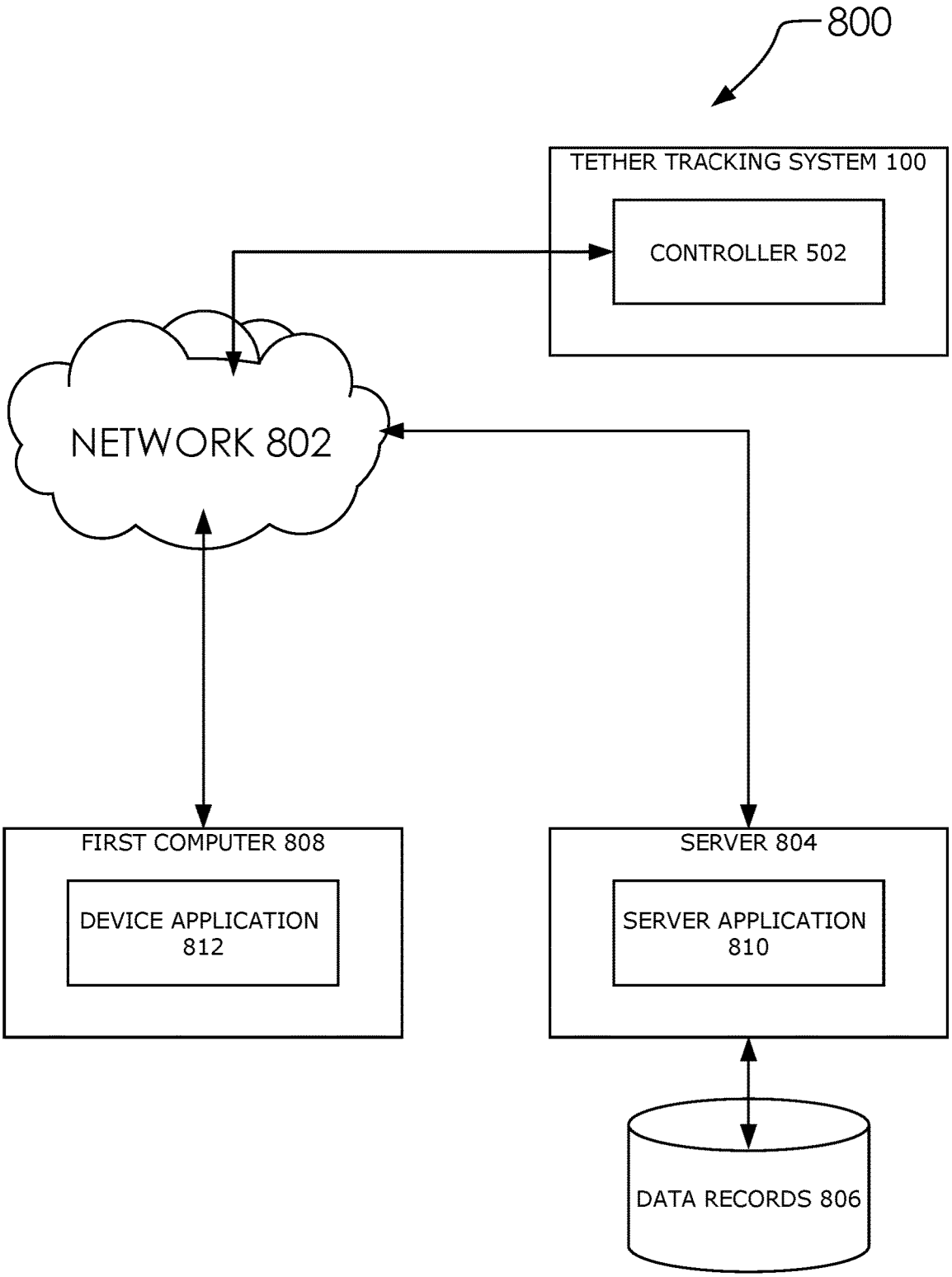
FIG. 8 illustrates a network diagram 800.

FIG. 8 illustrates a network diagram 800.

In one embodiment, said network diagram 800 can comprise a network 802, a server 804, a data records 806, and a first computer 808.

In one embodiment, said tether tracking system 100 can communicate oversaid network diagram 800 with said server 804 and/or said first computer 808. In one embodiment, said first computer 808 can be associated with said supervisor 118 with a responsibility to care for said worker 106 and/or said worksite 102.

In one embodiment, said server 804 can store records associated with said tether tracking system 100 and said worker 106 in said data records 806. Said server 804 can comprise a server application 810 configured to communicate with said data records 806 and said first computer 808. Said server 804 and said server application 810 can be configured to send to said first computer 808 according to user preferences.

Said first computer 808 can comprise a device application 812. In one embodiment, said server application 810 and said device application 812 can communicate with one another over said network 802, as is known in the art. In one embodiment, said device application 812 can comprise an app on a smart device, or similar, or a messaging app for receiving noncomplex text messages.

Figure 9:
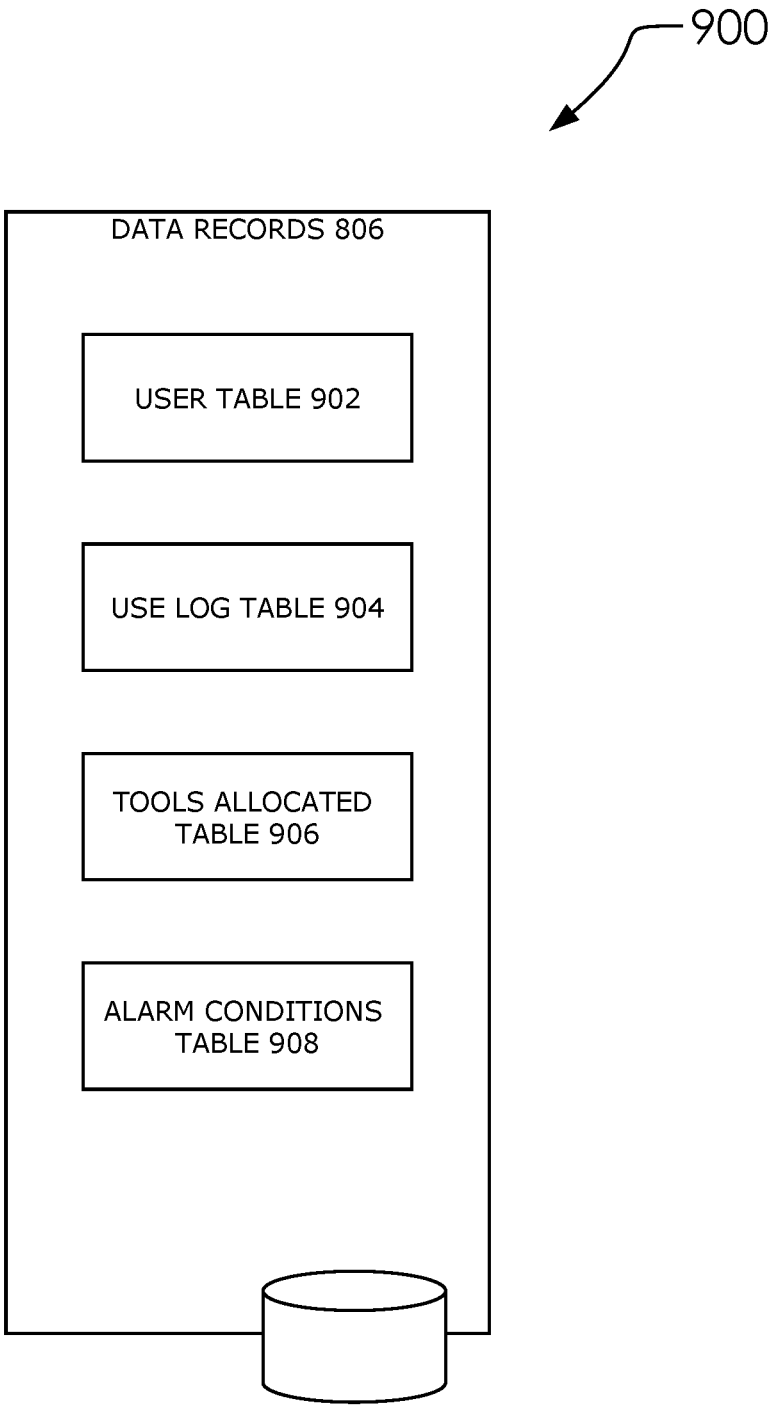
FIG. 9 illustrates a one or more data tables 900 managed by said server application 810.

FIG. 9 illustrates a one or more data tables 900 managed by said server application 810.

In one embodiment, said one or more data tables 900 can comprise an user table 902, an use log table 904, a tools allocated table 906, and an alarm conditions table 908. Said user table 902 can comprise a list of users, such as said worker 106, said lower elevation worker 114 and said supervisor 118. Said use log table 904 can comprise records related to actions of the users. Said tools allocated table 906 can comprise a list of tools (such as said tool 104, said first tool 702*a* and said second tool 702*b*) which are or have been associated with individual users. Said alarm conditions table 908 can comprise a record of alarm conditions associated with events determined by said method of use 600 or similar analysis of said controller 502, said server application 810 or said device application 812.

The following sentences are generated from the claims and represent at least one embodiment of the current disclosure:

Said tether tracking system 100 configured to secure and monitor said one or more tools 702 to prevent drops and accidents by said worker 106. Said tether tracking system 100 comprises said base portion 300, said two or more straps 302, said one or more hooks 304, said tool strap 318 and said one or more hook anchors 320. Said two or more straps 302 comprise at least said first strap 302*a* and said second strap 302*b*. Said first strap 302*a* comprises said first end 306 and said second end 308. Said second strap 302*b* comprises said first end 310 and said second end 312. Said two or more straps 302 can be attached to said base portion 300 with said second end 308 of said first strap 302*a* and said second end 312 of said second strap 302*b* attached to said base portion 300. Said first end 310 of said second strap 302*b* can be attached to said tool strap 318. Said tool strap 318 can be configured to selectively attach to one among said one or more tool tethers 710. Said one or more hook anchors 320 comprise at least said first hook anchor 320*a*. Said one or more hooks 304 comprise at least said first hook 304*a*. Said first end 306 of said first strap 302*a* can be attached to said first hook 304*a*. each among said one or more hooks 304 can be configured to selectively attach to said one or more hook anchors 320. Said tether tracking system 100 can be configured to monitor safety conditions of said one or more tools 702 by: attaching said controller 502 between said two or more ground signals 506 on said two or more lines 504. monitoring said two or more ground signals 506 to ensure that at least one of said two or more lines 504 can be grounded. sending an alarm signal with said controller 502 when said monitoring step 606 determines none of said two or more lines 504 can be grounded to said two or more ground signals 506. wherein, said two or more ground signals 506 can be associated with at least said one or more hook anchors 320. Said two or more lines 504 can be integrated into said two or more straps 302.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A tether tracking system configured to secure and monitor a one or more tools to prevent drops and accidents by a worker, wherein:

said tether tracking system comprises a base portion, a two or more straps, a one or more hooks, a tool strap and a one or more hook anchors;

said two or more straps comprise at least a first strap and a second strap;

said first strap comprises a first end and a second end;

said second strap comprises a first end and a second end;

said two or more straps are attached to said base portion with said second end of said first strap and said second end of said second strap attached to said base portion;

said first end of said second strap is attached to said tool strap;

said tool strap is configured to selectively attach to one among a one or more tool tethers;

said one or more hook anchors comprise at least a first hook anchor;

said one or more hooks comprise at least a first hook;

said first end of said first strap is attached to said first hook;

each among said one or more hooks are configured to selectively attach to said one or more hook anchors;

said tether tracking system is configured to monitor safety conditions of said one or more tools by:

attaching a controller between a two or more ground signals on a two or more lines;

monitoring said two or more ground signals to ensure that at least one of said two or more lines are grounded;

sending an alarm signal with said controller when a monitoring step determines none of said two or more lines are grounded to said two or more ground signals;

wherein, said two or more ground signals are associated with at least said one or more hook anchors; and said two or more lines are integrated into said two or more straps.

* * * * *